US008955621B1

(12) United States Patent
Eads et al.

(10) Patent No.: US 8,955,621 B1
(45) Date of Patent: Feb. 17, 2015

(54) GROOVED DRILL STRING COMPONENTS AND DRILLING METHODS

(75) Inventors: Brandon Barrett Eads, Spring, TX (US); Paul Gregory Kates, Waller, TX (US)

(73) Assignee: Turboflex, Inc., Waller, TX (US)

( * ) Notice: Subject to any disclaimer, the term of this patent is extended or adjusted under 35 U.S.C. 154(b) by 245 days.

(21) Appl. No.: 13/570,902

(22) Filed: Aug. 9, 2012

Related U.S. Application Data

(60) Provisional application No. 61/521,588, filed on Aug. 9, 2011.

(51) Int. Cl.
*E21B 17/22* (2006.01)

(52) U.S. Cl.
USPC ..... 175/323

(58) Field of Classification Search
CPC ..... E21B 17/20; E21B 17/22
USPC ..... 175/320, 323
See application file for complete search history.

(56) References Cited

U.S. PATENT DOCUMENTS

| | | | | |
|---|---|---|---|---|
| 3,085,639 | A | 4/1963 | Fitch | |
| 3,194,331 | A * | 7/1965 | Arnold | 175/323 |
| 3,360,960 | A * | 1/1968 | Massey | 464/183 |
| 4,465,146 | A | 8/1984 | Fitch | |
| 4,811,800 | A | 3/1989 | Hill et al. | |
| 5,040,620 | A | 8/1991 | Nunley | |
| 5,150,757 | A | 9/1992 | Nunley | |
| 5,535,837 | A | 7/1996 | Carlin | |
| 5,959,380 | A | 9/1999 | Gillett et al. | |
| 6,012,744 | A | 1/2000 | Wilson et al. | |
| 6,070,665 | A | 6/2000 | Singleton et al. | |
| 6,223,840 | B1 | 5/2001 | Swietlik | |
| 6,349,779 | B1 * | 2/2002 | Gilbert | 175/323 |
| 7,025,144 | B2 | 4/2006 | Haugen et al. | |
| 7,040,422 | B2 | 5/2006 | Springer | |
| 7,182,160 | B2 * | 2/2007 | Boulet | 175/320 |
| 2004/0060699 | A1 * | 4/2004 | Rastegar | 166/285 |

OTHER PUBLICATIONS

"Drill Bits & Services: Specialty Tools: Cutting Bed Impeller (CBI) Tool", 2009, Publisher: Halliburton.
"Drill Collars, Stabilizers, and Drillstring Components", 2008, Publisher: National Oilwell Varco.
"Hydroclean Designed for Maximum Hole Cleaning", May 1, 2010, Publisher: Vallourec Group.

* cited by examiner

*Primary Examiner* — William P Neuder
(74) *Attorney, Agent, or Firm* — Fellers, Snider, Blankenship, Bailey & Tippens, P.C.

(57) ABSTRACT

This specification discloses a drilling string, including drill pipe, drill collar, or sub for use in drilling operations, comprising at least one upset that has an outer surface having a plurality of grooves, wherein at least one of the grooves comprise a curved leading edge that is generally convex, a leading side, a trough having a generally convex curvature, a trailing side that extends in a substantially radial direction, and a trailing edge. The groove configuration results in improved transport of drilling fluids and cuttings and is especially beneficial for use in directional drilling operations.

48 Claims, 3 Drawing Sheets

GROOVED DRILL STRING COMPONENTS AND DRILLING METHODS

CROSS REFERENCE TO RELATED APPLICATIONS

This application claims the priority of U.S. Provisional Patent Application No. 61/521,588 entitled "DRILL COLLARS AND DRILLING METHODS," filed Aug. 9, 2011, the contents of which are hereby incorporated by reference.

FIELD OF THE INVENTION

This patent specification relates to subsurface drilling, including the drilling of oil and gas wells. Preferably, but not exclusively, this patent specification relates to methods and devices for directional drilling, and drilling structures and components forming parts of drill strings including drill-string components such as drilling collars, drill pipe, and subs.

BACKGROUND OF THE INVENTION

When subsurface wellbores are drilled, such as for oil or natural gas production, the drilling operation typically generates cuttings that must be removed. To remove those cuttings fluid substances known as "drilling mud" may be circulated through the various parts inside the wellbore, including casing and various parts of the drill string including drill pipe and any subassembly and the drill bit. As used herein, the term "fluid" shall broadly mean any liquid or liquid-like material that is circulated through the wellbore, including not only water but also drilling mud (which includes various chemicals and materials designed to add "weight" to the drilling mud) and any solids, including cuttings and sand.

In the past, a variety of approaches have been used to facilitate drilling operations. Many of those approaches, including various types of grooved drill collars, are described in various prior art publications or patents, including those listed on the face of the patent. While certain of those approaches are purported to have advantages or benefits for specific applications, the inventors perceive that they also have shortcomings, and that a need exists for the devices, methods, and systems described herein.

SUMMARY OF THE INVENTION

Disclosed herein are a number of drilling apparatuses, some of which include a drill collar for use in drilling operations, including at least one upset that has an outer surface having a plurality of grooves, wherein at least one of the grooves comprises: (a) a curved leading edge that is generally convex; (b) a leading side; (c) a trough having a generally convex curvature; (d) a trailing side that extends in a substantially radial direction; and (e) a trailing edge.

Also disclosed herein are drilling apparatus exemplified by a drill collar for use in drilling operations, including a plurality of grooves formed into a spiral configuration around the outer surface, at least one of the grooves having a leading edge, leading side, trough, trailing side, and trailing edge, wherein the leading side and the trailing side are separated by the trough, and wherein in a cross-sectional view of the groove the leading side is longer than the trailing side, and wherein the radial curvature of the leading edge is greater than the radial curvature of the trailing edge.

Further, this specification also discloses a number of drilling methods, including a method for drilling an oil or gas well that includes lowering a drill string into a wellbore, which drill string includes a drill bit and a tubular structure selected from the group of drill collars, drill pipe, and subs, wherein the tubular structure includes at least one section that has an outer surface having a plurality of grooves, and wherein at least one of the grooves comprises: (a) a curved leading edge that is generally convex; (b) a leading side; (c) a trough having a generally convex curvature; (d) a trailing side that extends in a substantially radial direction; and (e) a trailing edge. For all tubing structures described above, the maximum outer diameter of the grooved section is preferably no larger than the outer diameter of other enlarged sections so as not to inhibit sliding of the grooved section within a well.

DETAILED DESCRIPTION OF THE PREFERRED EMBODIMENTS

Figure 1:
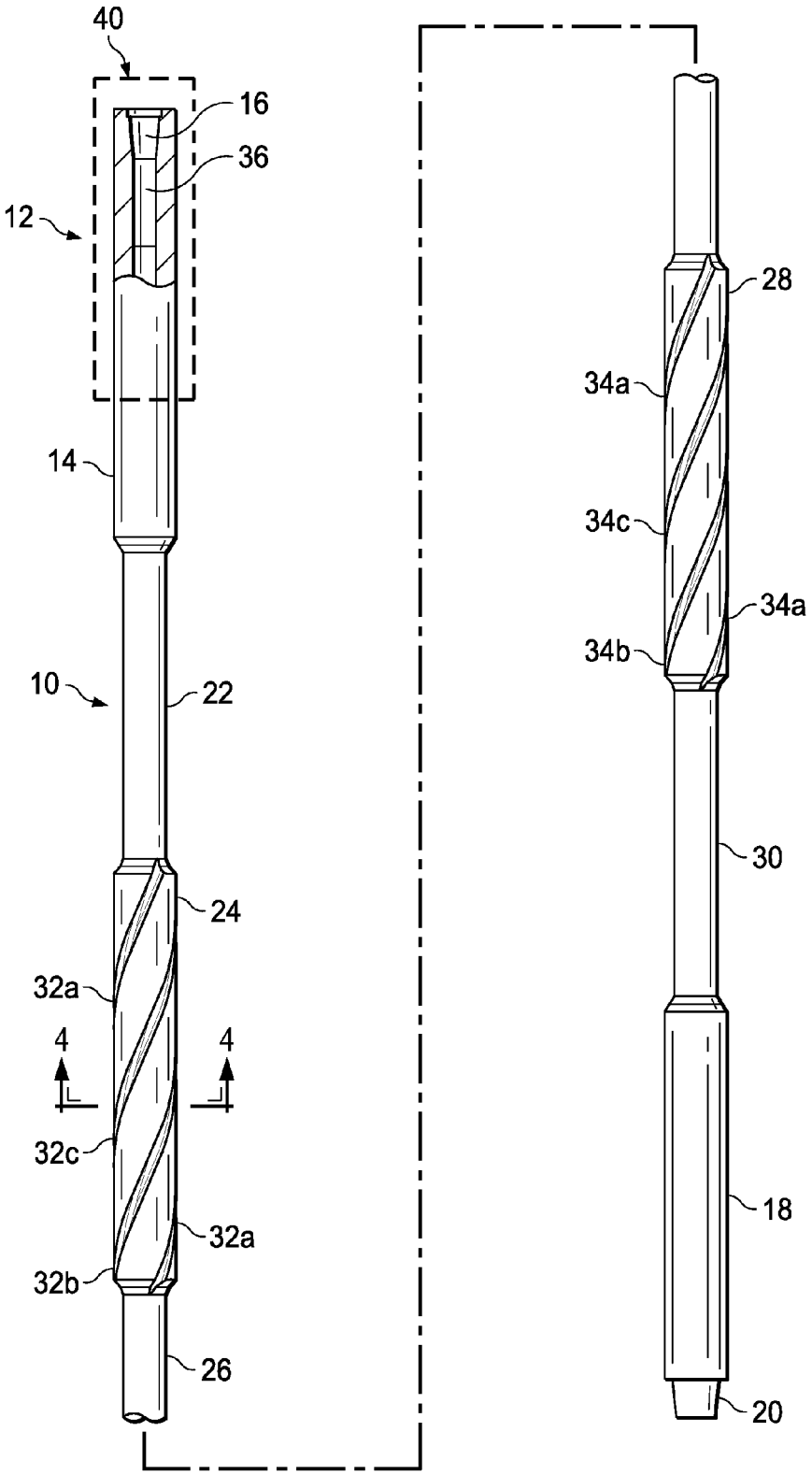
FIG. 1 is an illustration of a drill collar having two upsets, including a first end section shown in partial cross-section.

The term "convex" as used herein refers to any outwardly curved surface, including but not limited to one or more surfaces of any drilling structure discussed and illustrated herein, e.g., a drill collar or sub, or a groove forming part of a drill collar or sub. Examples of convex surfaces are shown in the drawings. The term "concave" is used herein to mean curving inwards at or near a middle portion. For example, any portion of the outside of an egg, a ball, an oval or a circle would be considered convex. And any portion of the inside of an egg, a ball, an oval or a circle would be considered concave. These terms do not require the curvature or radius of an object to be constant or regularly shaped.

The term "connecting," as used herein, means any act of providing for a connection, including securing and coupling. The term "connection" means any structure or device that is capable of securing or coupling one structure to at least one other structure. A "connection" may be some intermediate structure that is separate and different from the structures being connected, although the connection can also be an integral part of one of the structures, e.g., a "pin" or "box" that connects two pipe joints together or a drill collar to a pipe joint.

Disclosed herein are a number of drilling apparatuses, some of which include a tubular structure (e.g., a drill collar, drill pipe, or sub) for use in drilling operations, including at least one upset that has an outer surface having a plurality of grooves, wherein at least one of the grooves comprises: (a) a curved leading edge that is generally convex; (b) a leading side; (c) a trough having a generally convex curvature; (d) a trailing side that extends in a substantially radial direction; and (e) a trailing edge.

At least certain grooved tubular structures disclosed herein (e.g., a drill collar, drill pipe, or a sub) are for use in drilling operations, and they may include a plurality of grooves formed into a spiral configuration around the outer surface, at least one of the grooves having a leading edge, leading side, trough, trailing side, and trailing edge, wherein the leading side and the trailing side are separated by the trough, and wherein in a cross-sectional view of the groove the leading side is longer than the trailing side, and wherein the radial curvature of the leading edge is greater than the radial curvature of the trailing edge. One benefit of forming the groove in a spiral shape is to minimize drag when sliding the drilling apparatus within the well bore. The portion of the groove that contacts a wall of the well bore when the drilling apparatus is sliding is small due to the spiral shape. Further, a portion of the groove that contacts the wall is smooth, which minimizes drag.

Also disclosed herein are a number of drilling methods, including a method for drilling an oil or gas well that includes lowering a drill string into a wellbore, which drill string includes a drill pipe, drill bit and a tubular structure selected from the group of drill collars and subs, wherein the tubular structure includes at least one section that has an outer surface having a plurality of. grooves, and wherein at least one of the grooves comprises: (a) a curved leading edge that is generally convex; (b) a leading side; (c) a trough having a generally convex curvature; (d) a trailing side that extends in a substantially radial direction; and (e) a trailing edge.

In one or more of the drill collars, drill pipe, or other tubular structures disclosed herein, the groove is capable of transporting a portion of drilling fluid in the proximity of the curved leading edge into the groove toward the trough when the tubular body is rotated during drilling.

In one or more of the drill collars, drill pipe, or other tubular structures disclosed herein, the rotation of the tubular structure during a drilling operation in the presence of drilling mud and cuttings is capable of causing the movement of drilling mud past the leading edge of the groove and past the leading side of the groove and is further capable of causing a change of direction of the drilling mud at the trough and the transporting of the drilling mud along the groove path.

In one or more of the drill collars, drill pipe, or other tubular structures disclosed herein, the groove has a leading side that slopes inward to the trough.

In one or more of the drill collars, drill pipe, or other tubular structures disclosed herein, the trough has a generally convex curvature.

In one or more of the drill collars, drill pipe, or other tubular structures disclosed herein, the groove has a trailing side that extends in a substantially radial direction from an axial center point of the drill collar to the trailing edge.

In one or more of the drill collars, drill pipe, or other tubular structures disclosed herein, the groove has a substantially angled trailing edge.

In one or more of the drill collars, drill pipe, or other tubular structures disclosed herein, the substantially angled trailing edge is approximately 90 degrees.

In one or more of the drill collars, drill pipe, or other tubular structures disclosed herein, the rotation of the upset is capable of transporting drilling mud that enters the groove at the leading edge in a substantially radial direction away from the axial center of the upset and substantially parallel to the trailing side.

In one or more of the drill collars, drill pipe, or other tubular structures disclosed herein, each of the plurality of grooves extends longitudinally in a spiral along the outer surface of the offset.

One or more of the drilling methods disclosed herein includes transporting drilling fluid in a radial direction into the groove in proximity to the leading side and out of the groove in proximity to the trailing side, while drilling fluid is moving in a longitudinal direction out of the wellbore.

One or more of the drilling methods disclosed herein includes transporting cuttings in the drilling fluid.

One or more of the drilling methods disclosed herein includes using the tubular member in directional drilling.

One or more of the drilling methods disclosed herein includes reducing the likelihood that the tubular member becomes stuck when the tubular member is positioned in a portion of the wellbore that is more horizontal than vertical.

One or more of the drilling methods disclosed herein involves use of a tubular member with a groove having an angled trailing edge.

One or more of the drilling methods disclosed herein involves use of a tubular member having an angled trailing edge is approximately 90 degrees relative to a tangent to the outer surface of the section that includes the groove.

One or more of the drilling methods disclosed herein involves use of a tubular member with a groove that extends longitudinally in a spiral.

One or more of the drilling methods disclosed herein involves use of a tubular member with a second groove and a third groove positioned on the tubular member.

At least one example of a grooved tubular drilling apparatus is shown the drawings. In FIG. 1, the drilling apparatus is a drill collar 10, but the apparatus may alternatively be any other tubular component of a drill string that has spiral grooves as described in greater detail below, including a drill pipe, drilling "sub" or an upset. Alternatively, the drilling apparatus may be defined as a drill string that includes any of such components, or a drilling rig in combination with a drill bit and tubular components such as joints of drill pipe and drill collars as described herein. The apparatus in FIG. 1 includes a drill collar 10 that may be used as part of a drill string (not shown) for oil or natural gas drilling. In some embodiments, the drill collar 10 may be about 32 feet long. A first end section 14 has a box 16 suitable for connecting drill collar 10 to another component in the drill string. A second end section 18 has a pin 20, suitable for connecting drill collar 10 to another component in the drill string, e.g., a joint of pipe or another drill collar. For example, box 16 may be configured to receive a pin from another component in the drill string. Pin 20 may be threaded so as to screw into a threaded box in another component of a drill string. In this manner, various components may be coupled together.

Drill collar 10 depicted in FIG. 1 also has a first upset 24 and a second upset 28. Each upset has a set of three spiral grooves, i.e., grooves 32*a*-32*c* and 34*a*-34*c*, respectfully. Grooves 32*a*-32*c* and 34*a*-34*c* extend inwardly from the perimeter of a tubular structure, e.g., upsets 24, 28, on which grooves 32*a*-32*c* and 34*a*-34*c* are formed. Narrow tubular sections 22, 26 and 30 may be staggered along the tubular body of the drill collar 10. In FIG. 1, narrow section 22 is positioned between the first end section 14 and the first upset 24. Narrow section 26 is positioned between the first and second upsets 24 and 28. And narrow section 30 is positioned between the second upset 28 and the second end section 18. As shown, the outer diameters of the end sections 14 and 18 and the upsets 24 and 28 is greater than the outer diameters of the narrow tubular sections 22, 26 and 30. Upsets 24 and 28 are shown with three spiral grooves, i.e., 32*a*-32*c* and 34*a*-34*c*, respectively. However, other numbers of grooves are also possible. One aspect of the invention is maintaining sufficient mass in upsets 24 and 28 to reduce vibration, which is especially important in "measurement while drilling tools" (MWD tools). Therefore, Applicant prefers three grooves, as shown, but upsets 24, 28 may also have two to four grooves or one to five grooves. Additionally, in a preferred embodiment, depth of grooves 32*a*-32*c*, 34*a*-34*c* remains constant until the grooves exit from the end of an upset. A constant depth allows fluid and cuttings to exit even if the outer diameter of the tool is in contact with a well bore.

Figure 2:
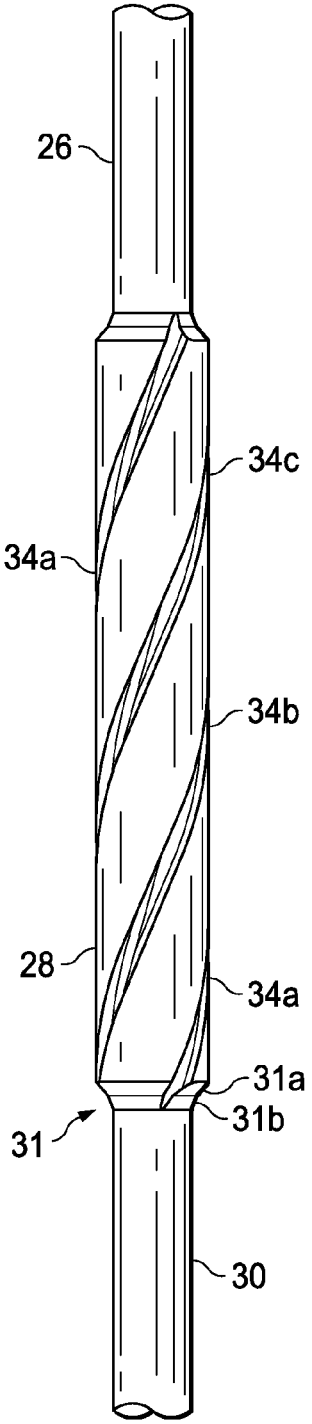
FIG. 2 is a side view of a drill collar upset, showing the location and pitch of three grooves.
Figure 4:
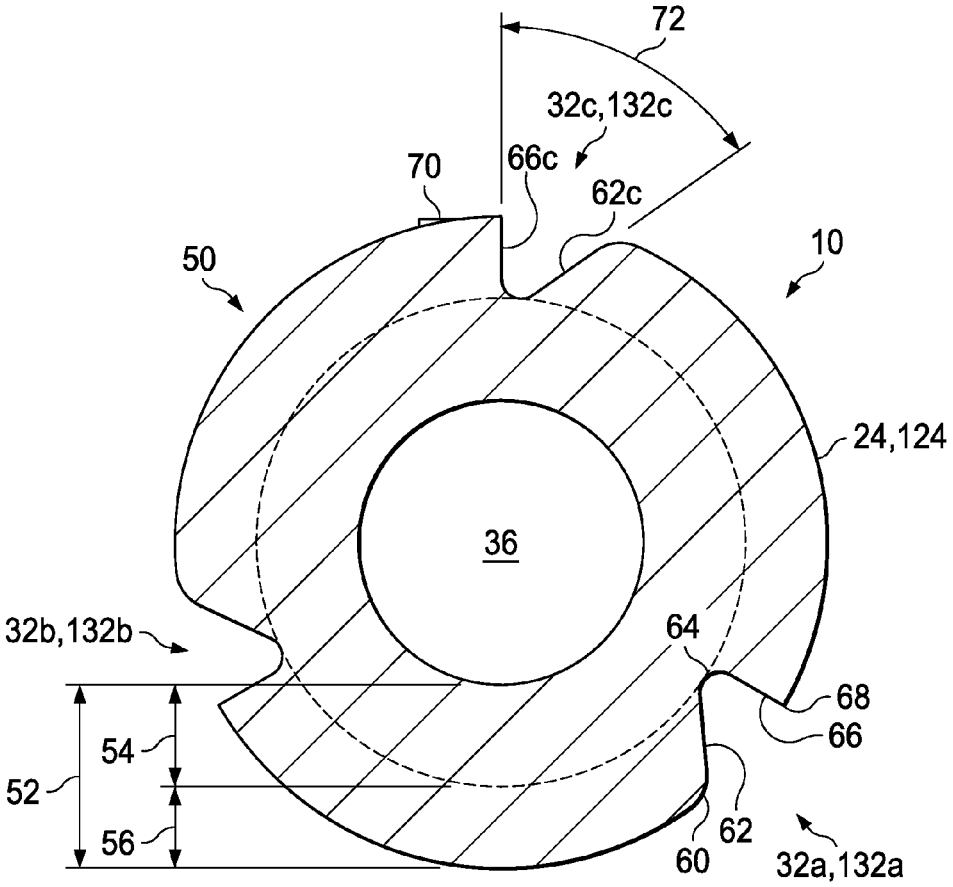
FIG. 4 is a cross sectional view of a tubular structure, such as an upset or sub showing a groove shape.

As illustrated in FIGS. 1 and 4, drill collar 10 is tubular in shape and has an internal conduit 36 capable of receiving drilling fluid. The first end section 14 depicted in FIG. 1 includes a partial cutaway view 40 of the internal conduit 36. The internal conduit 36 extends through the length of drill collar 10, including through the pin 20. FIG. 2 illustrates the second upset 28, with spiral grooves 34*a*, 34*b* and 34*c*, positioned between narrow section 26 and narrow section 30. The tubular body of the drill collar 10 may be machined as one piece. Although FIG. 2 is discussed in the context of drill collar 10, it should be understood that second upset 28 may be located at desired intervals on a length of drill pipe. As illustrated in FIG. 1, a section with a larger diameter, e.g., second end section 18, may be connected to a narrower section, e.g., narrow section 30, by a tapered section 31 (FIG. 2). Alternatively, tapered section 31 may not be included, such as the section between second end section 18 and pin 20 shown in FIG. 1.

As shown in FIG. 1, interior conduit 36 should have the same inner diameter substantially throughout the length of the drill collar 10. Drill collar 10, as illustrated, includes five sections, i.e., two large-diameter end sections 14, 18 and two grooved "upsets" 24, 28. As used herein, the term "upset" has the broadest meaning and definition given that term in the industry. However, upsets 24, 28 described herein have grooves 32*a*, 32*b*, 32*c*, and 34*a*, 34*b*, 34*c* as described herein. Narrow tubular section 26 separates grooved upsets 24, 29, and narrow tubular sections 22, 30 separate each upset 24, 28 from one of the end sections 14, 18. First end section 14 and second end section 18 and first upset 24 and second upset 28 preferably have thicker walls than the walls of the narrow sections 22, 26 and 30. Narrow sections 22, 26 and 30 preferably have the same or substantially the same wall thickness as the drill pipe. Alternatively, narrow sections 22, 26, and 30 are illustrative of lengths of drill collar 10 in an embodiment wherein sections 14, 24, and 28 are located on a length of drill pipe. Narrow sections 22, 26, 30 provide the drill collar 10 with flexibility. This flexibility gives the tubular component of the drill string, e.g., drill collar 10, an advantage in directional drilling, because the long tubular components of the drill string are flexible enough to make turns when the wellbore changes direction inside the earth. For purposes of this application, a drill collar provided with flexible sections, such as narrow sections 22, 26, 30, shall be referred to as a "flex collar". The sections with thicker walls, such as end sections 14, 18 and first and second upsets 24 and 28, provide added weight and strength to the drill collar 10. The first and second upsets 24 and 28 may be about four feet long. In other specific embodiments, one or more additional upsets may be provided. In other embodiments or for other applications, upsets and narrow sections may not be used at all. For example, a drill collar may be provided having a single substantially uniform diameter with one or more spiral grooves such as those described herein along a desired length of the outside of the drill collar. The drill collar 10 may be made of any metal or alloy used for conventional drill collars, including a nonmagnetic material, such as nonmagnetic steel, so as not to interfere with MWD (measurement while drilling) equipment, which may be magnetic.

Figure 3:
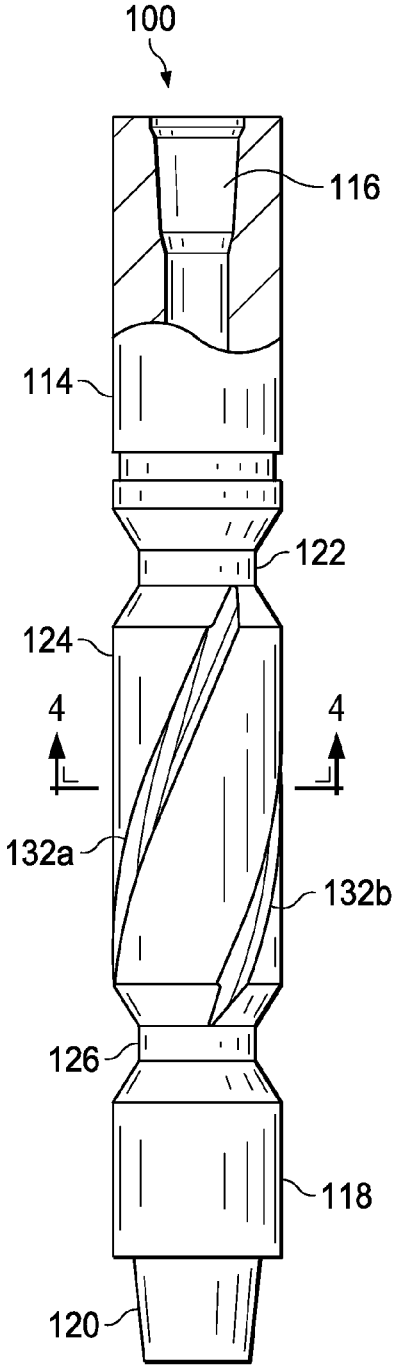
FIG. 3 is a side view of a sub connected to a drill string.

Referring now to FIG. 3, shown is another drill string component, i.e., a "sub", that may benefit from application of the grooves of the invention. "Sub", as used herein, refers to any small component of a drill string, such as a short drill collar or a thread crossover. Sub 100, shown in FIG. 3, includes first end section 114, has a box 116 suitable for connecting to other drill string components. A second end section 118 has a pin 120 suitable for connecting sub 110 to other drill string components. Pin 120 may be threaded so as to screw into a threaded box of another component of the drill string.

Sub 110, as shown in FIG. 3, has upset 124 that defines a plurality of spiral grooves, e.g., grooves 132*a*, 132*b*. An additional spiral groove, e.g., 132*c*, may be provided but which is not visible in FIG. 3. First narrow tubular section 122 is positioned between first end section 114 and upset 124. Second narrow tubular section 126 is positioned between upset 124 and second end section 118. Additional upsets or narrow sections may be provided as desired.

During drilling operations, drill collar 10 is rotated, causing the drill bit at the bottom of the hole to grind and cut the formation, which may be rock, or the formation can be sand or shale. The rotating drill bit produces "cuttings," and the weight placed on the drill bit causes the entire drill string to move slowly downward, i.e., away from the surface, and to "make hole." Of course, in directional and horizontal drilling, the drill string is not moving in a strictly downward direction but is nevertheless moving in a direction away from the entry point, where the "spudding in" occurred. During drilling, fluid (including water and/or drilling mud) is circulated through the wellbore to remove cuttings from the well-bore. Water is typically circulated initially when the drill bit is at relatively shallow depths and for certain purposes. However, the favored fluid for removing cuttings is drilling mud, which is weighted with additives and thus is capable of transporting the cuttings up and out of the hole. Fresh drilling mud (from which cuttings have been removed) is circulated in a downhole direction through interior conduit 36 (FIGS. 1, 4), and thus passes through the drill-string components. The drilling mud exits through apertures in the drill bit and mixes with the cuttings near the drill bit. Moving upward, the mud passes through the annular space between the outer surface of the drill string and the inner surface of the hole created by drilling. The upwardly-moving mud carries with it the cuttings. (Sometimes the hole is referred to as the "wellbore," and other times "wellbore" is a term used to refer to the hole plus the drill string and other components). Cuttings thus tend to flow upward with the drilling mud in the wellbore outside the tubular body of the drill string, e.g., the drill collar 10. In the examples illustrated in the figures, the drill collar 10 is intended to rotate clockwise. The spiral grooves 32*a*-32*c*, 34*a*-34*c*, formed in the upsets 14 and 18 assist the movement of the drilling mud outside the drill collar, including the movement of cuttings being carried by the drilling mud.

Referring now to FIG. 4, a cross section 50 is illustrated of first upset 24 from the perspective of line 4-4 of FIG. 1 and/or of upset 124 from the perspective of line 4-4 of FIG. 3. Upset 24, 124 has an "overall wall thickness" 52. The overall wall thickness 52 is the sum of first wall thickness 54 and second wall thickness 56. First wall thickness 54 may be similar or about the same as the wall thickness of one or more of the narrow sections 22, 26 and 30. Second wall thickness 56 provides an outer surface with a diameter that is greater than the diameter of narrow sections 22, 26 and 30.

As discussed below in greater detail, the groove shape and configuration (including pitch) of grooves 32*a*-32*c*, 34*a*-34*c*, 132*a*-132*c*, influences the movement of drilling mud and cuttings. In the embodiment shown in FIG. 4, groove 32*a*, 132*a* has an outwardly curved leading edge 60, which is convex. Groove 32*a*, 132*a* also has a leading side 62 that slopes inward to a bottom trough 64. The bottom trough 64 curves inwards, and is thus concave. Groove 32*a*, 132*a* also has a trailing side 66 that extends in a substantially radial direction and ends in a trailing edge 68. —Trailing edge 68 may be angled. Grooves 32*b*, 132*b* and 32*c*, 142*c* may be shaped similarly or the same as groove 32*a*, 132*a*. In a further embodiment, trailing edge 66*c* of groove 32*c*, 132*c* forms a right angle with a tangent line 70 to the outer circumference of upset 24, 124. In another embodiment, trailing side 66*c* forms an angle 72 with the leading side 62*c*. In one embodiment, the angle may be about 49 degrees to 65 degrees. In a preferred embodiment, angle 72 may be machined to 56 degrees.

Groove Configuration and Geometry

Certain important features of at least some of the structures described herein are the configuration and geometry of the grooves, not only of each individual groove but also the combination of grooves. In directional drilling applications, gravity tends to act on drill string components, including drill collars, so that the components are not centrally positioned with respect to the axis of the wellbore. In a horizontal wellbore, gravity may cause the drill collar, including particularly the heavier upset portions, to fall closer to a lower side of the wellbore, thus creating an area or zone in the annular space between the outer surface of the lowest part of drill collar (relative to the earth surface) and the corresponding walls of the wellbore that is smaller than the area or zone in the annular space between the opposite or elevated part of the drill collar (relative to the earth surface). Accordingly, in that lower area or zone, there tends to be less annular space for drilling mud to flow in an axial direction. As a consequence, cuttings tend to accumulate in those zones or areas. The accumulated cuttings have the potential to cause or contribute to causing the drill collar or other tubular structure, and consequently the entire drill-string, either to become "stuck" in the wellbore, so that it completely stops rotating or to make rotation more difficult as a result of the additional friction added by the cuttings. It has been discovered that the groove shape and configurations described herein effectively propels cuttings away from these smaller or restricted areas, and back into the drilling mud that is flowing axially and upward away from the drill bit. Consequently, as a result of using the apparatus described herein, including the groove shapes and configurations, it is contemplated that the aforementioned problems are reduced.

Pitch

At least one of the important features of certain specific embodiments is the pitch of the grooves. As seen in the various drawings, including FIG. 1, each of the grooved tubular structures should have multiple grooves that spiral circumferentially around at least a portion of the tubular structure. In the example of FIG. 1, the grooves spiral downward in a clockwise rotation. Also, it is preferred that each of the grooved tubular structures have more than one set or series of grooves. The grooves have a spiral configuration that follows the outer contour or surface of the particular tubular structure that is grooved, e.g., the upsets. In at least one embodiment, all the grooves have the same pitch. Each groove preferably has the same pitch as the other grooves on the same tubular structure, which can be either an entire drilling collar or an individual upset or other component that is part of the apparatus in question. However, in other embodiments, the pitch of the grooves may differ from one another. That is, for example, in one embodiment, a drilling collar having two upsets may have an upper upset having three grooves with the same pitch but may have a lower upset having three grooves with a different pitch than the pitch of the three grooves on the upper upset. In other embodiments, each of the upsets may have multiple grooves that are different in pitch. One of the benefits or advantages of providing for different pitches as described above is that a groove with one particular pitch will transport cuttings differently than the way a groove with another pitch will transport cuttings. When the drilling fluid (including sand, cuttings and other solid particles) makes contact with one groove, the interaction between fluid and groove will result in the fluid being transported in one particular direction and with one particular set of forces, while drilling fluid interacting with another groove having a different pitch (or other geometry, as discussed below) will result in a different fluid transportation. The grooves preferably have a pitch between 24" and 48", i.e., a groove makes one rotation of an upset every 24" to 48" of upset length. Most preferably, the groove has a pitch of 48". It has been discovered that too much pitch results in too much drilling mud being transported in a radially outward direction and not enough transported or urged in an axial direction, while too little pitch results in too little drilling mud being transported in a radially outward direction.

Figure 5:
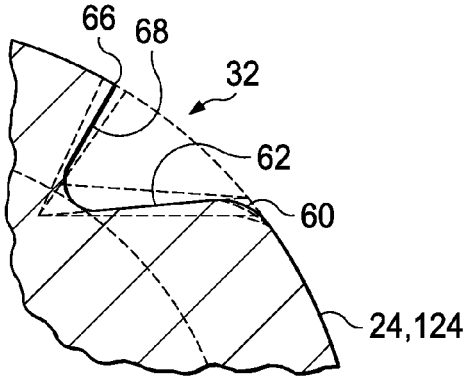
FIG. 5 is a partial cross sectional view of tubular structure including a groove.

FIGS. 4 and 5 show a cross-section of a portion of the drilling apparatus, e.g., upsets 24, 124. The cross-section is perfectly perpendicular to the axis of the tubular structure, e.g., 24, 124.

Shape

An important feature of the recited structures is the shape of at least one of the grooves (where shape is defined in terms of the cross-sectional contour(s) of the groove. It is understood that any discussion of the shape(s) of grooves found on a particular structure is not a suggestion that all the grooves of the particular structure necessarily have that same shape. For example, certain structures may have other grooves in addition to the grooves shown in the drawings or in addition to grooves having any one of the particular shapes described in this paragraph, and such structures are nevertheless considered to be within a preferred class of structures. A depiction of at least one of the preferred grooves, viewed in cross-section, is seen in FIGS. 4-5. FIG. 5 includes various dotted lines to indicate example alternative surface directions and lengths, depths, angles and radii. For definitional and discussion purposes, each groove is considered to have at least five parts or elements, i.e., the leading edge 60, the leading side 62, the trough 70, the trailing side 66, and the trailing edge 68.

The Leading Edge

The first "part" of the groove is the "leading edge 62" of the groove 32, which is preferably curved, with an outward curve as shown in FIG. 6, i.e., a convex surface having a radius. The smooth leading edge 60 provides for reduced resistance as the drill collar or other tubular structure rotates, and makes it less likely for that the overall drill string to get stuck in the wellbore. Although the convex surface of leading edge 60 may be perfectly circular, with a single fixed radius, the convex surface may alternatively (in certain embodiments) be oval or elliptical, having a variable radius. In at least one embodiment, the radius of the curve is itself pitched from the imaginary radius thus having an axial component to it, so that fluid passing in an axial direction relative to the axis of the tubular structure will make contact with the leading edge 60 in a more perpendicular angle. Preferably, when the radius of the leading edge curve 60 is pitched, the drilling fluid flows over the leading edge 60 in a more axial direction than it would flow if the radius of the leading edge curve 60 were not pitched. As discussed elsewhere herein, the inventors contemplate a trade-off between (a) the transporting of the drilling fluid (including mud, sand and cuttings) in an axial direction and (b) the transporting of the drilling fluid in a radial direction toward the inner surface of the borehole.

It is to be understood that the terms "axial" and "radial" as used herein are relative terms that use the tubular structure's axis as a reference point (unless indicated otherwise). Furthermore, anything that is characterized as "axial" may also have (and usually will have) a radial component; likewise, anything characterized as "radial" may also have (and usually will have) an axial component. However, anything characterized herein as axial is considered to be more axial (have a larger axial component) than radial, and anything characterized as radial is considered to be more radial (have a larger radial component) than axial. For example, a fluid that moves in an axial direction is moving in a line that is more aligned with the axis of the overall tubular apparatus (including each of the tubular structures that are components of the apparatus) than with the radius of the tubular apparatus. Similarly, a fluid that moves in a radial direction is moving in a line that is more aligned with the radius of the tubular apparatus.

It is further understood that any structures (or line or other feature of a structure) referred to herein as "axial" or "radial" are considered to be at least substantially axial or radial and not necessarily perfectly axial (perfectly aligned with the axis of the borehole or the tubular structure) or perfectly radial (perfectly aligned with an imaginary line extending as a straight from the axial center of the tubular structure or borehole at a 90 degree angle from the axis). Rather, the term axial means that the direction of the thing being characterized (fluid, or borehole, or tubular structure) is more axial than radial, i.e., the thing's axial component is greater than its radial component. The term "axial" may also refer to an "axial component," where all directions other than a perfect radial direction have at least some axial component. The term "radius" may also refer to a "radial component," where all directions other than a perfect radial direction have at least some axial component. In yet another specific embodiment, the leading edge is not curved at all, but includes a series of flat surfaces, each of which is gradually more radial and correspondingly less axial. For example, a first flat surface component (i.e., part or element) of the leading surface has an angle of 5 degrees from the axial, the second adjoining flat surface component has an angle of 15 degrees from the axial, and the third adjoining flat surface has an angle of 35 degrees from the axial, and in that specific embodiment the next surface adjoining that third flat leading edge surface is the leading side of the groove, discussed below.

Leading Side 62

Another element of any of the grooves described herein is the leading side 62, exemplified as leading side 62 in FIG. 4. When a tubular structure, such as a drill collar or sub, turns (rotates) clockwise (looking down-hole), that tubular structure rotates towards, or in the direction of, the leading edge 60. Adjacent the leading edge 60, and preferably adjoining it, is the leading side 62 which slopes from the innermost side of the leading edge 60, i.e., the side of the leading edge 60 closest to the center of the tubular structure, which center coincides with the axis of the tubular structure, toward the trough 64, and preferably is regarded as ending when the "trough" 64 begins. In at least certain specific embodiments, the slope of the leading side 62 is critical. As noted above, the slope of the leading side 62 relative to the imaginary radial line extending from the outside surface of the tubular structure, at what may be regarded as the leading edge 60, which is preferably an imaginary straight line, of the leading edge 60 (which, as discussed above, is actually a convex surface). In at least certain specific embodiments, the slope of the leading side 62 is different than the slope of the trailing side 66 (discussed below). Also, another critical feature of at least certain specific embodiments of the drilling apparatus (and the drilling method) is the angle formed between the leading side 62 and the trailing side 66 of a particular groove. That leading side 62/trailing side 66 angle (which may alternatively be referred to as the trough angle) is preferably greater than 45 degrees, but less than 90 degrees, and is preferably between 50 and 75 degrees, and more preferably approximately 60 degrees. A third critical feature of the leading side 62, in at least certain specific embodiments, is that (a) the length of the leading side 62 is longer than the length of the trailing side 66 or (b) the length of the leading side 62 combined with the length of the leading edge 60 is longer than the length of the trailing side 66 combined with the length of the trailing edge 68. In both of those contexts, "length" is measured along the surface of the particular sides and edges toward the central axis of the tubular structure, i.e., in a substantially radial direction. For example, the length of the leading side 62 and edge 60 (measured from the central point of the leading edge 60 to the central point of the trough 64) is longer than the length of the trailing side 66 and edge 68 measured from the central point of the trough 64 to the central point of the trailing edge 68.

The features of the apparatus described herein that are believed to provide for improved results include the shapes of the leading edge 60 and the leading side 62. During drilling operations, as the tubular structure turns clockwise, drilling fluid passes over the exterior (outer surface) of the tubular structure, e.g., the drill collar 10 in a longitudinal direction, i.e., axial with respect to the wellbore and tubular structure. As described in greater detail below, the spiral shapes of the grooves 32, 34 provide for increased mixing of the drilling mud and cuttings. The grooves 32, 34 also influence the movement of drilling mud and cuttings in the radial direction. The curved shape of the leading edge 60 provides for more laminar flow of fluid (including drilling mud and cuttings) than the flow of the fluid passing over the edge of the trailing side 66, which is more turbulent. The inwardly curved trough 64 redirects drilling fluid, including mud and cuttings, in a radial direction and away from the trough 64 and eventually out of the groove 32, 34. As the flat trailing side pushes drilling mud it encounters in the direction the drill collar is rotating, the overall effect is to increase turbulence in the drilling mud as it exits the groove 32, 34, thus providing additional transport forces for cuttings.

Trough 64

Another part of certain grooves 32, 34, as discussed herein, is the trough 64, which is located between leading edge 60 (discussed above) and the trailing edge 68 (discussed below). Preferably, the trough 64 has a curved surface and is concave, with one portion being adjacent to, and preferably adjoining, the leading edge 60, and another portion being adjacent to, and preferably adjoining, the trailing edge 68. Preferably, the inflection point of the trough 64 is curved and not sharp or pointed so that mud and cuttings move smoothly from the leading side 62, to the trough 64, to the trailing side 66. In the specific embodiment that includes a drill collar with a grooved offset, the lowest point of the trough 64 (the point closest to the axis of the tubular structure, e.g., 14, 124) preferably coincides with the outer surface of the narrow sections, e.g., 22, 26, 122, 126, so that the radial distance from the axis of the tubular structure, e.g., 24, 124, to the lowest point of the trough 64 is substantially the same as a radial distance from the axis to the outer surface of the narrow sections, e.g., 22, 26, 122, 126, of the drill collar. In the context of FIG. 4, when the apparatus depicted therein is used in a drilling operation, drilling mud in proximity to leading edge 60 is transported into the groove 32*a* by the movement of the curved edge 60 and the inwardly sloped leading side 62 relative to the drilling mud. The inwardly curved trough 64 redirects drilling mud in a radial direction out of the groove 32*a*. The shape and orientation of the flat trailing side 66 causes drilling mud to be transported in a radial direction, with the overall effect being to increase turbulence in the drilling mud and provide additional transport effects for cuttings.

Trailing Side 66

The fourth part of the grooves 32, 34 described herein is the "trailing side" 66. Preferably, in any of the specific embodiments, the trailing side 66 is oriented more radially than the orientation of the leading side 62. More preferably, the trailing side 66 is oriented at a perfect right angle (90 degrees) with respect to the tangent to the outer surface of the tubular structure, although that angle may also be slightly greater, i.e., 95, 100, 110 degrees, or even as much as 120 degrees. A trailing edge oriented at approximately 90 degrees allows drilling mud to flow through groove 32, 34 to self clean.

Trailing Edge 68

The fifth part of the grooves 32, 34 described herein is the "trailing edge" 68. Preferably, in any of the specific embodiments, the trailing edge 68 is sharper than the leading edge 60, and preferably forms a substantial right angle as depicted in FIG. 4. Trailing edge 68 and the outer surface of tubular structure 24, 124 form a lip that is preferably sharp, i.e., a lip formed by joining the two surfaces at a point as opposed to joining the two surfaces with a segment having a radius. The sharp lip, therefore, functions as a superior scoop as compared to a rounded lip. The combined purpose of the shapes and geometries of the trailing side 66 and trailing edge 68 discussed herein is to function as both a scoop for any accumulated cuttings that enter the groove 32, 34 and a sling to direct the cuttings in a radial direction.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A drill string structure comprising:

at least one narrow section having a first diameter;

at least one large diameter section having a relatively larger diameter than said first diameter, said large diameter section adjacent to said narrow section and having a outer diameter;

wherein said large diameter section defines at least one spiral groove that extends inwardly from said outer diameter;

wherein said spiral groove defines a trailing edge having a lip joining a trailing side and an outer surface of said large diameter section;

wherein said spiral groove defines a leading edge joining a leading side and said outer surface of said large diameter section;

wherein said lip of said trailing edge of said spiral groove is sharper than said leading edge of said spiral groove.

2. The drill string structure according to claim 1 wherein: the drill string structure is a drill collar.

3. The drill string structure according to claim 2 wherein: said narrow section is flexible for enabling said drill string structure to function as a flex collar for facilitating directional drilling.

4. The drill string structure according to claim 1 wherein: the drill string is a drill pipe.

5. The drill string structure according to claim 1 wherein: the drill string structure is a sub.

6. The drill string structure according to claim 1 wherein: said large diameter section is an upset.

7. The drill string structure according to claim 1 wherein: said at least one spiral groove comprises a plurality of grooves.

8. The drill string structure according to claim 7 wherein: said at least one spiral groove comprises one to five grooves.

9. The drill string structure according to claim 8 wherein: said at least one spiral groove comprises two to four grooves.

10. The drill string structure according to claim 9 wherein: said at least one spiral groove comprises 3 grooves.

11. The drill string structure according to claim 1 wherein: said groove comprises a curved leading edge that is generally convex, a leading side, a trough having a generally convex curvature, a trailing side, and a trailing edge.

12. The drill string structure according to claim 1 wherein: said groove has a leading side that slopes inwardly to a trough.

13. The drill string structure according to claim 1 wherein: said groove has a trough having a generally convex curvature.

14. The drill string structure according to claim 1 wherein: said groove has a trailing side that extends substantially radially from a longitudinal axis of the drill string structure.

15. The drill string structure according to claim 1 wherein: said groove has a trailing edge that is oriented at an angle with respect to a radial line extending from a longitudinal axis of the drill string structure.

16. The drill string structure according to claim 1 wherein: said groove has a leading edge and a trailing edge; and an angle formed by said leading edge and said trailing edge is between approximately 49 and 65 degrees.

17. The drill string structure according to claim 16 wherein:

said angle formed by said leading edge and said trailing edge is between approximately 53 and 59 degrees.

18. The drill string structure according to claim 17 wherein:

said angle is approximately 56 degrees.

19. The drill string structure according to claim 1 wherein: said groove defines a trough having a bottom, said bottom of said trough a first distance from a longitudinal axis of the drill string structure;

wherein said first distance is approximately equal to a radius of said at least one narrow section.

20. The drill string structure according to claim 1 wherein: said at least one spiral groove has a cross-sectional area and has an upper end and a lower end; and said cross-sectional area remains constant from said upper end to said lower end.

21. A drill string structure comprising:

at least one grooved section having a first diameter;

wherein said grooved section defines at least one groove that extends inwardly from said first diameter;

wherein said groove has a leading side that slopes inwardly to a trough and a trailing side that extends substantially radially from a longitudinal axis of the grooved section.

22. The drill string structure according to claim 21 further comprising:

at least one narrow section having a second diameter;

said at least one narrow section adjacent to said grooved section.

23. The drill string structure according to claim 21 wherein:

the drill string structure is a drill collar.

24. The drill string structure according to claim 23 wherein:

said narrow section is flexible for enabling said drill collar to function as a flex collar for facilitating directional drilling.

25. The drill string structure according to claim 21 wherein:

the drill string structure is a sub.

26. The drill string structure according to claim 21 wherein:

the drill string structure is a drill pipe.

27. The drill string structure according to claim 21 wherein:

said grooved section is an upset.

28. The drill string structure according to claim 21 wherein:

said at least one groove comprises a plurality of grooves.

29. The drill string structure according to claim 28 wherein:

said at least one groove comprises one to five grooves.

30. The drill string structure according to claim 29 wherein:

said at least one groove comprises two to four grooves.

31. The drill string structure according to claim 30 wherein:

said at least one groove comprises three groves.

32. The drill string structure according to claim 21 wherein:

said groove comprises a curved leading edge that is generally convex, a leading side, a trough having a generally convex curvature, a trailing side, and a trailing edge.

33. The drill string structure according to claim 21 wherein:

said trough has a generally convex curvature.

34. The drill string structure according to claim 21 wherein:

an angle formed by said leading edge and said trailing edge is between approximately 49 and 65 degrees.

35. The drill string structure according to claim 34 wherein:

said angle formed by said leading edge and said trailing edge is between approximately 53 and 59 degrees.

36. The drill string structure according to claim 35 wherein:

said angle is approximately 56 degrees.

37. The drill string structure according to claim 21 wherein:

a bottom of said trough is approximately a first distance from said grooved section;

wherein said first distance is approximately equal to a radius of said at least one narrow section.

38. The drill string structure according to claim 21 wherein:

said at least one groove has a cross-sectional area and has an upper end and a lower end;

said cross-sectional area remains constant from said upper end to said lower end.

39. A method for drilling an oil or gas well, comprising the steps of:

lowering a drill string into a wellbore, said drill string having a tubular structure selected from the group of a drill pipe, drill collars and subs, wherein said tubular structure includes at least one grooved section that has an outer surface defining a groove, said groove having a leading side that slopes inwardly to a trough and a trailing side that extends substantially radially with regard to a longitudinal axis of the grooved section.

40. The method of claim 39 further comprising the steps of:

transporting drilling fluid in a radial direction into the groove in proximity to the leading side and out of the groove in proximity to the trailing side, while drilling fluid is moving in a longitudinal direction out of the wellbore.

41. The method of claim 40 further comprising the steps of:

transporting cuttings in said drilling fluid.

42. The method of claim 39 further comprising the step of:

utilizing said tubular structure in directional drilling.

43. The method of claim 42 further comprising the step of:

transporting cuttings in a portion of the well bore that is more horizontal than vertical for reducing a likelihood that the tubular structure becomes stuck in the wellbore.

44. The method of claim 39 wherein:

said groove has an angled trailing edge.

45. The method of claim 44 wherein:

said drill string further comprises at least one narrow tubular section;

said tubular structure has a greater diameter than said narrow tubular section;

said angled trailing edge is approximately 90 degrees relative to a tangent to the outer surface of said grooved section.

46. The method of claim 39 wherein:

said groove extends longitudinally in a spiral along said outer surface of said grooved section.

47. The method of claim 39 wherein:

said outer surface of said grooved section defines a second groove and a third groove.

48. The method according to claim 39 wherein:

said groove has a cross-sectional area and has an upper end and a lower end;

said cross-sectional area remains constant from said upper end to said lower end.

* * * * *